US005343712A

United States Patent [19]

Gowan

[11] Patent Number: 5,343,712

[45] Date of Patent: Sep. 6, 1994

[54] TEMPERATURE CONTROLLER AND METHOD FOR FACILITATING THE STORAGE OF WINE AND LIKE PERISHABLES

[75] Inventor: William A. Gowan, Raleigh, N.C.

[73] Assignee: Precision Storage, Inc., Raleigh, N.C.

[21] Appl. No.: 92,255

[22] Filed: Jul. 15, 1993

[51] Int. Cl.[5] ..... F25B 49/02

[52] U.S. Cl. ..... 62/126; 62/157; 62/229; 62/326

[58] Field of Search ..... 62/126, 129, 130, 229, 62/326, 157, 231, 228.1, 226, 163, 161, 208, 213; 236/46 F

[56] References Cited

U.S. PATENT DOCUMENTS

| | | | |
|---|---|---|---|
| 3,470,705 | 10/1969 | Hall | 62/326 X |
| 3,500,649 | 3/1970 | Feldman | 62/3 |
| 3,510,860 | 5/1970 | Christman | 62/126 X |
| 3,754,408 | 8/1973 | Littleton | 62/302 |
| 3,804,482 | 4/1974 | Smith | 312/236 |
| 4,169,357 | 10/1979 | Kelley | 62/126 |
| 4,283,921 | 8/1981 | Prosky | 62/126 |
| 4,630,449 | 12/1986 | Adams | 62/130 |
| 4,634,046 | 1/1987 | Tanaka | 236/46 F |
| 4,843,833 | 7/1989 | Polkinghorne | 62/180 |
| 5,012,973 | 5/1991 | Dick et al. | 236/46 |
| 5,038,851 | 8/1991 | Mehta | 165/12 |
| 5,060,486 | 10/1991 | Linstromberg | 62/229 |
| 5,191,773 | 3/1993 | Cassell | 62/373 |

OTHER PUBLICATIONS

1993 IWA Gift Catalog (International Wine Accessories), pp. 3, 27, 30–35.

The Wine Enthusiast (Wine Cellars and Giftware), vol. 23, No. 4A, pp. 7, 21, 25–27, 36–49; 1991.

*Primary Examiner*—Harry B. Tanner

*Attorney, Agent, or Firm*—Bell, Seltzer, Park & Gibson, P.A.

[57] ABSTRACT

A temperature controller for facilitating the storage of wine and like perishables in a household refrigeration unit includes a temperature sensing device, adapted to be positioned in a chilled compartment of the refrigeration unit, and a temperature controller circuit, operatively connected to the temperature sensing device, for overriding an internal thermostat of the refrigeration unit. The temperature controller circuit maintains the refrigeration unit's chilled compartment at a desired user selected wine storage temperature by periodically enabling and disabling the supply of electrical power from an external power supply to the refrigeration unit's chiller (e.g., compressor). The temperature controller circuit is maintained in a housing adapted to be positioned on or adjacent the refrigeration unit. The housing may also include a display for visually indicating the temperature of the chilled compartment. Unlike conventional household refrigeration units, the cooling of the chilled compartment is not performed on a continuous basis until the user selected wine storage temperature is reached, but instead is performed on a more gradual basis using a series of consecutive cooling and non-cooling periods.

28 Claims, 3 Drawing Sheets

TEMPERATURE CONTROLLER AND METHOD FOR FACILITATING THE STORAGE OF WINE AND LIKE PERISHABLES

FIELD OF THE INVENTION

This invention relates to temperature controllers for refrigeration systems and methods of controlling same and, more particularly to controllers and methods for preserving wine and other perishables for extended periods of time.

BACKGROUND OF THE INVENTION

Refrigeration units for storing perishables such as wine for extended periods of time are known to the art. For example, U.S. Pat. No. 3,500,649 to Feldman discloses a household wine storage chest having a control unit for regulating the inside temperature of the chest to a wine storage temperature of about 55° F., plus or minus 5° F. The chest includes a hinged outer door for allowing access to the chest compartment. A heat barrier is also provided adjacent the door to prevent the escape of cool air from within the compartment. The heat barrier includes circular openings therethrough for accessing individual bottles of wine and also includes removable plugs retained in the openings, around the necks of the stored bottles. For applications in which the chest is subject to widely varying external temperatures, the control unit may be upgraded to include an automatic thermostat to maintain proper temperature at around 55° F.

Another unit, including a modular refrigerated cabinet with removable wine rack is disclosed in U.S. Pat. No. 3,754,408 to Littleton. And in U.S. Pat. No. 3,804,482 to Smith, a wine storage cabinet is disclosed with a refrigerated housing and a plurality of bins for storing a relatively large number of wine bottles. Because of the construction of the cabinet, a thermal gradient is set up between the lowermost portions of the cabinet, adjacent the refrigerated housing, and the uppermost portions of the cabinet. Thus, wine bottles stored at the top of the cabinet experience a slightly higher storage temperature than bottles at the bottom. However, because the storage temperature for red wine is preferably higher than that for white wine, white wine bottles can be stored at the bottom and red wine bottles can be stored at the top. For a wine collection of either solely white or red wine, however, the thermal gradient will cause the storage of some bottles at a preferred temperature and others at a somewhat non-preferred temperature.

In addition to the above-mentioned refrigeration units for storing wine, a wide variety of other units can be purchased from International Wine Accessories, Inc. ("IWA") of Dallas, Tex. In particular, IWA distributes numerous stand-alone wine refrigeration models, as well as modular wine room systems having capacities of a thousand or more wine bottles. Many of these units offer precise temperature control from 50°–65° F. and humidity control from 50–70% relative humidity. Similar units are also marketed and distributed by The Wine Enthusiast, Inc. of Pleasantville, N.Y. As well known to those skilled in the art of wine preservation, both temperature and relative humidity must be controlled within certain well-recognized limits in order to provide acceptable long term storage. For example, storing wines for extended periods of time at a too high relative humidity can cause the formation of mold on the corks and on the wine labels, thus adversely affecting the aesthetic value of the stored wine. A too low relative humidity can cause the corks to deteriorate by drying out and facilitate the escape of wine during storage.

Each of these above-mentioned examples represents a "dedicated" refrigeration unit for maintaining wine at a predetermined storage temperature. As such, these dedicated units ("wine-coolers") may not be suitable for the storage of perishables other than wine. For example, because wine storage temperatures of 50°–65° F. are significantly higher than those required for the storage of perishables such as milk, vegetables, poultry, etc., the chillers (i.e., compressors) used in wine coolers are typically of relatively lower power-rating when compared to those used in household refrigerators of equivalent size. Accordingly, if a wine enthusiast's collection of wines increases in size, larger wine coolers will typically have to be purchased at the expense of rendering the previously used smaller wine coolers obsolete for the storage of perishables other than wine. In addition, because dedicated wine coolers are typically sold at a significant premium by gourmet and specialty shops, relative to the cost of an ordinary household refrigerator, the cost of storing wine for extended periods of time can be significant.

One attempt to operate a conventional household refrigerator as a wine cooler is disclosed in U.S. Pat. No. 5,060,486 to Linstromberg. Linstromberg discloses a thermostat for providing temperature control of a chilled compartment of a household refrigerator at multiple set-point temperatures. The thermostat includes set-points for off, wine cooler, refrigerator and freezer modes of operation. The set-point temperature for the wine cooler mode is between 55° F. and 60° F. Unfortunately, although a set-point is provided specifically for wine, the refrigerator still regulates the temperature of the chilled compartment in a conventional fashion. Thus, when the thermostat recognizes an unacceptably high compartment temperature, the chiller will turn on and remain running until the set-point temperature is again reached. Unfortunately, as well known to those skilled in the art of wine preservation, cooling wine quickly from a relatively high temperature to the proper storage temperature can adversely affect wine and hinder the efficacy of storing wine for extended periods of time in conventional household refrigerators.

Thus, notwithstanding these developments, there continues to be a need for a device that can be used to convert a conventional refrigerator into an economical cooler for storing wine and like perishables in a preferred manner for extended periods of time. There also continues to be a need for a device that is readily interchangeable between refrigerators of different size to allow for the expansion of a wine enthusiast's collection, without rendering a previously used refrigerator obsolete for other than wine storage use.

SUMMARY OF THE INVENTION

It is therefore an object of the present invention to provide a temperature controller for converting an ordinary household refrigerator into a unit for storing wine and like perishables for extended periods of time.

It is also an object of the present invention to provide temperature controller for maintaining a refrigeration unit's chilled compartment at a preferred wine storage temperature, and controlling fluctuations in the temperature of the chilled compartment in a preferred manner.

It is a further object of the present invention to provide a temperature controller that can be readily installed in any stand-alone refrigeration unit.

It is still another object of the present invention to provide a method for controlling the temperature of a refrigeration unit.

These and other objects are provided according to the present invention, by a temperature controller for converting an ordinary refrigeration unit, of the type including an electrically powered chiller, a chilled compartment and a thermostat for controlling the chiller, to a unit for storing wine and other perishables for extended periods of time. The controller comprises a housing adapted to be positioned on or adjacent the refrigeration unit, temperature sensing means adapted to be positioned in the chilled compartment and means, operatively connected to the temperature sensing means for overriding the control of the chiller by the thermostat.

Overriding the thermostat control of the chiller is performed, in part, by enabling the supply of electrical power from an electrical power supply to the chiller when a sensed temperature of the chilled compartment is above a first preselected temperature and by disabling the supply of electrical power to the chiller when the sensed temperature is below the first preselected temperature. Accordingly, by setting the refrigeration unit's thermostat to a temperature setting below the first preselected temperature, independent control of the temperature of the chilled compartment can be achieved by enabling the supply of electrical power to the chiller only when the temperature of the chilled compartment is above the first preselected temperature.

In a preferred embodiment, the overriding means does not enable the continuous supply of electrical power to the chiller when the temperature of the chilled compartment is above the first preselected temperature, but instead enables and disables the supply of electrical power during each of a plurality of consecutive cooling intervals while the temperature of the chilled compartment is being lowered to the first preselected temperature. Accordingly, the temperature controller does not provide for the continuous and rapid cooling of the chilled compartment, but stages the cooling of the chilled compartment in a gradual descent to the first preselected temperature. As will be understood by those skilled in the art of wine preservation, gradually cooling wine from a relatively high temperature to a first preselected storage temperature using a series of consecutive cooling intervals is a preferred method of cooling wine.

The overriding means also preferably controls the length of each cooling interval as a function of the temperatures sensed during a respective preceding cooling interval(s). In particular, each cooling interval begins with an enable period, during which time electrical power is provided to the chiller to cool the chilled compartment, and concludes with a disable period during which time the chiller is rendered inactive by the removal of electrical power. The length of the enable period is also preferably dependent on the temperature of the chilled compartment sensed at the commencement of a respective preceding cooling interval and the temperature sensed at the end of that cooling interval. That dependency is preferably an inverse dependency, whereby the length of a particular enable period is inversely proportional to the difference between the temperature sensed at the commencement of a respective preceding cooling interval and the temperature sensed at the end of that interval. The overriding means can preferably comprise any one of a number of commercially available off-the-shelf 8-bit or equivalent microcontrollers and the temperature sensing means preferably comprises a thermistor.

The temperature controller also preferably includes means, mounted on the housing, for visually displaying the sensed temperature of the chilled compartment relative to a second preselected temperature. The second preselected temperature may be the desired wine storage temperature (e.g., 53° F.) and may equal the first preselected temperature, however, as will be understood by those skilled in the art, the first preselected temperature may be slightly higher than the second preselected temperature, depending on whether there is a small range of temperatures above the desired wine storage temperature that will be tolerated before the controller will initiate a new cooling interval, beginning with a new enable period.

According to the present invention, means for visually displaying the sensed temperature of the chilled compartment includes a light emitting diode. Illumination of the light emitting diode is preferably controlled by means for adjustably illuminating the brilliance of the light emitting diode to an increased level as the sensed temperature of the chilled compartment approaches the second preselected temperature. Means is also provided for visually displaying an alarm condition if the sensed temperature of the chilled compartment exceeds the second preselected temperature by a preselected temperature range (e.g., the difference between the first and second preselected temperatures) for a preselected period of time (e.g., 24 or 48 hours). In addition, the temperature controller further comprises means responsive to user actuation for selecting the second preselected temperature. The second preselected temperature may be the desired wine storage temperature (e.g., 53° F.) or may be a desired wine serving temperature, such as 47° F. for white wine or 63° F. for red wine.

DETAILED DESCRIPTION OF A PREFERRED EMBODIMENT

The present invention now will be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1A:
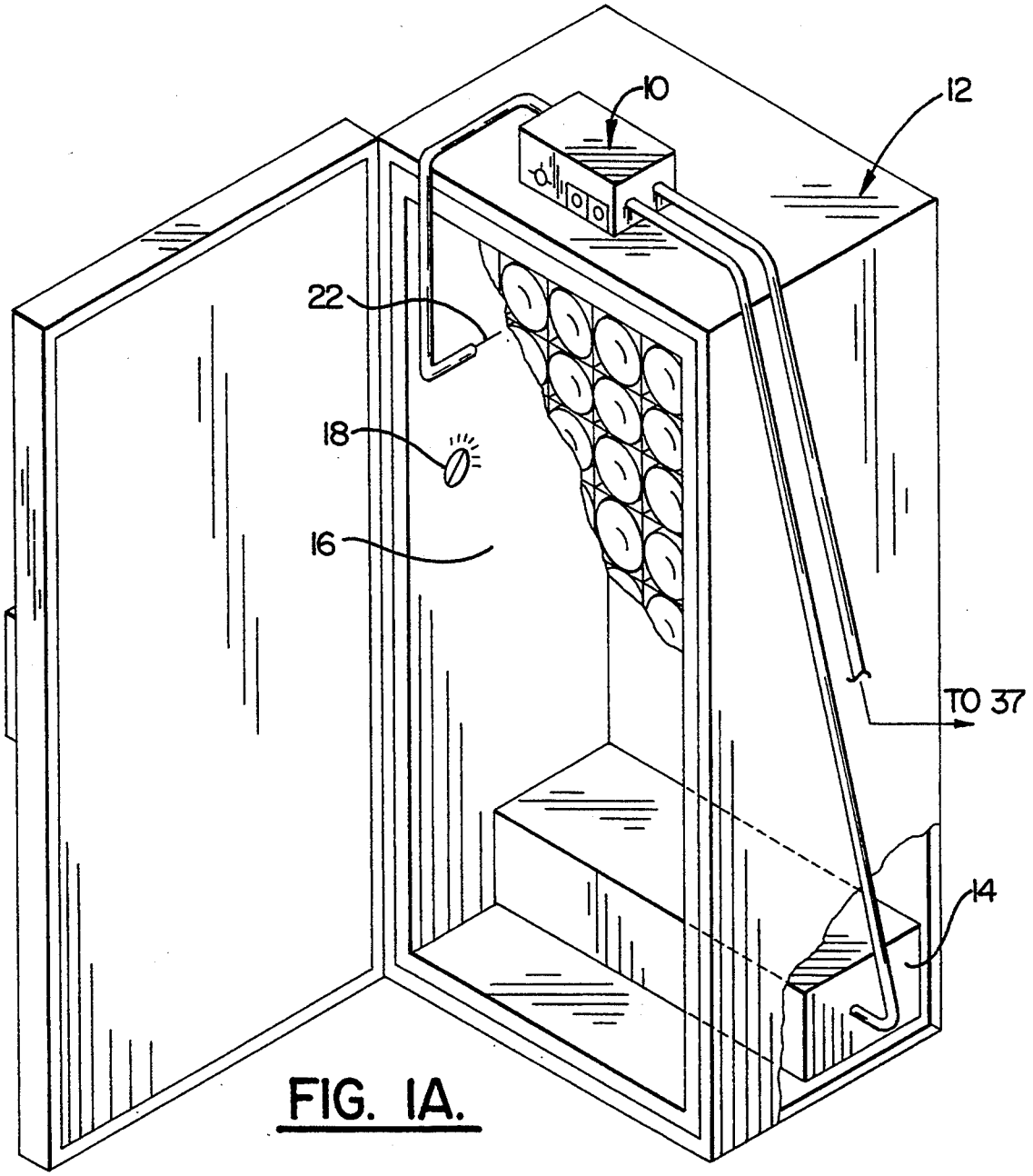
FIG. 1A illustrates a conventional household refrigeration unit, adapted to include the temperature controller according to one embodiment of the present invention.
Figure 1B:
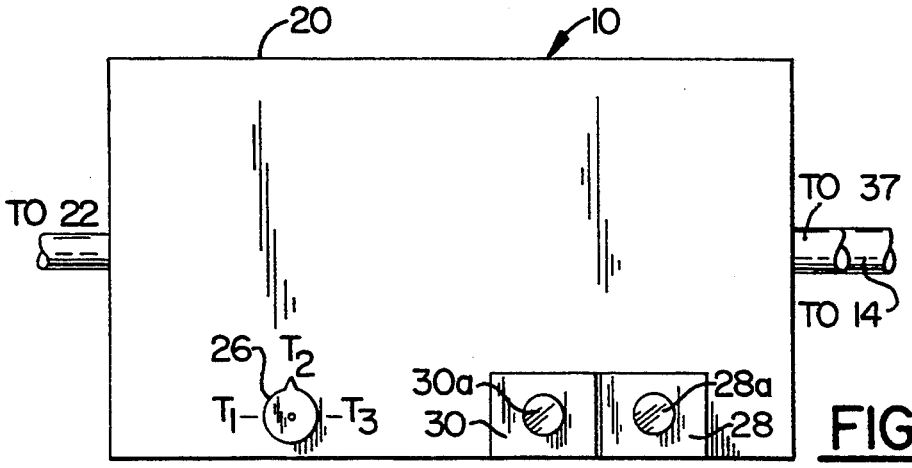
FIG. 1B is a front perspective of the temperature controller according to the embodiment of FIG. 1A.
Figure 2:
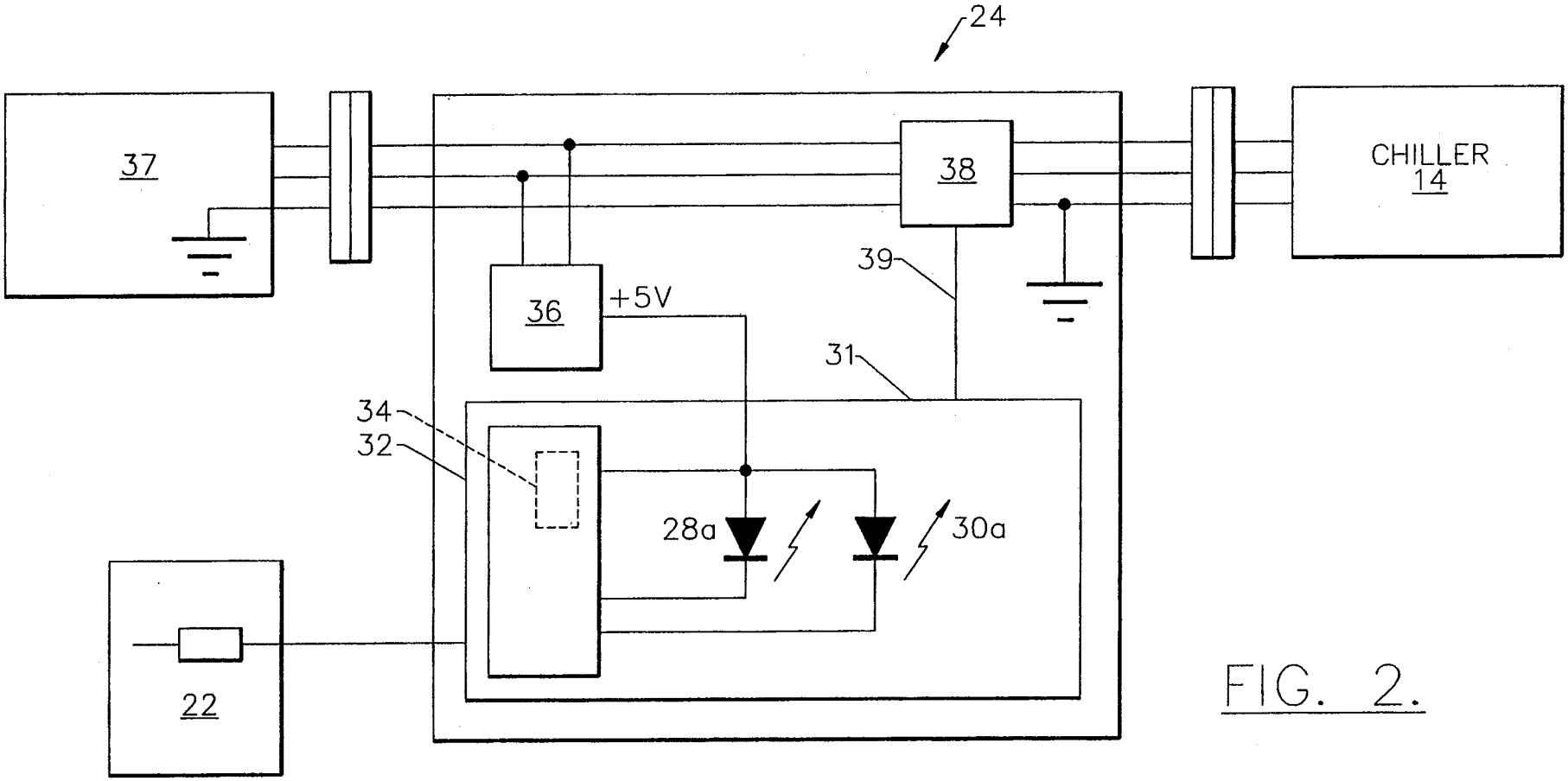
FIG. 2 is a block schematic representation of the circuit for overriding the thermostat control of the chiller shown in FIG. 1A.

Referring now to FIGS. 1 and 2, a temperature controller 10 for converting a refrigeration unit 12 of the type including an electrically powered chiller 14, a chilled compartment 16 and a thermostat 18 for controlling operation of the chiller 14 according to the present invention will be described. The refrigeration unit 12 is preferably a frost-free refrigerator or freezer. The frost-free feature helps to eliminate the presence of excess moisture in the chilled compartment during storage, which can lead to deterioration of the wine labels and the formation of mold. If long term storage is to occur under relatively humid external ambient conditions or if a non frost-free refrigeration unit is to be used, a moisture absorbing material such as a desiccant manufactured and sold by W. A. Hammond Drierite Co. can be used in the refrigeration compartment.

The temperature controller 10 comprises a housing 20, means 22 for sensing a temperature of the chilled compartment 16 and means 24 operatively connected to the temperature sensing means 22 for overriding the thermostat control of the chiller 14.

The housing 20 is adapted to be positioned on or adjacent the refrigeration unit 12 as shown, and includes user actuated temperature selecting means 26, alarm condition displaying means 28 and sensed temperature displaying means 30. The temperature selecting means 26 preferably comprises a switch, mounted to the front face of the housing 20, for selecting one of three preferred temperatures: (I) white wine serving temperature (47° F.), (II) wine (red or white) storage temperature (53° F.), and (III) red wine serving temperature (63° F.). Means 30 for displaying the sensed temperature of the chilled compartment 16 is also provided on the face. Means 30 preferably comprises a light emitting diode 30*a* (e.g., green).

Overriding means 24 may further include means 34, associated with the temperature sensing means 22, for adjustably illuminating the light emitting diode 30*a* to an increased brilliance as the sensed temperature of the chilled compartment 16 approaches a user selected temperature (i.e., 47° F., 53° F. or 63° F.). In addition, means 28 preferably comprises a light emitting diode 28*a* (e.g., red) for displaying an alarm condition if the difference between the sensed temperature of the chilled compartment 16 exceeds the user selected temperature by a predetermined amount for a preselected period of time (e.g., 24 or 48 hours). The temperature sensing means 22 is preferably coupled to the housing 20 and affixed inside the chilled compartment 16 (as shown) using conventional techniques (e.g., tape). Temperature sensing means 22 may comprise a thermistor, such as a Model 17M002-5 thermistor, manufactured and distributed by Dale Electronics Corporation.

In the preferred embodiment, the means 24 for overriding the thermostat control of the chiller 14, preferably comprises (i) a temperature controller circuit 31 including a microcontroller 32 (such as a commercially available off-the-shelf 8-bit or equivalent microcontroller); (ii) voltage regulating means 36 for regulating the electrical power supply 37 and for generating a power supply voltage (e.g., 5 volts) for operation of the microcontroller 32; and (iii) means 38 (e.g., power relay) for electrically connecting the chiller 14 to the electrical power supply 37 when the microcontroller 32 generates a predetermined output on signal line 39. As will be understood by those skilled in the art, means 34 for adjustably illuminating the light emitting diode 30*a* can be performed by the microcontroller in conjunction with other elements of the temperature controller circuit 31. In order to insure proper control of the chiller 14 by overriding means 24, the thermostat 18 must be set to a temperature setting below the user selected temperature, thereby causing the chiller 14 to turn-on in response to the supply of electrical power from the overriding means 24.

Figure 3:
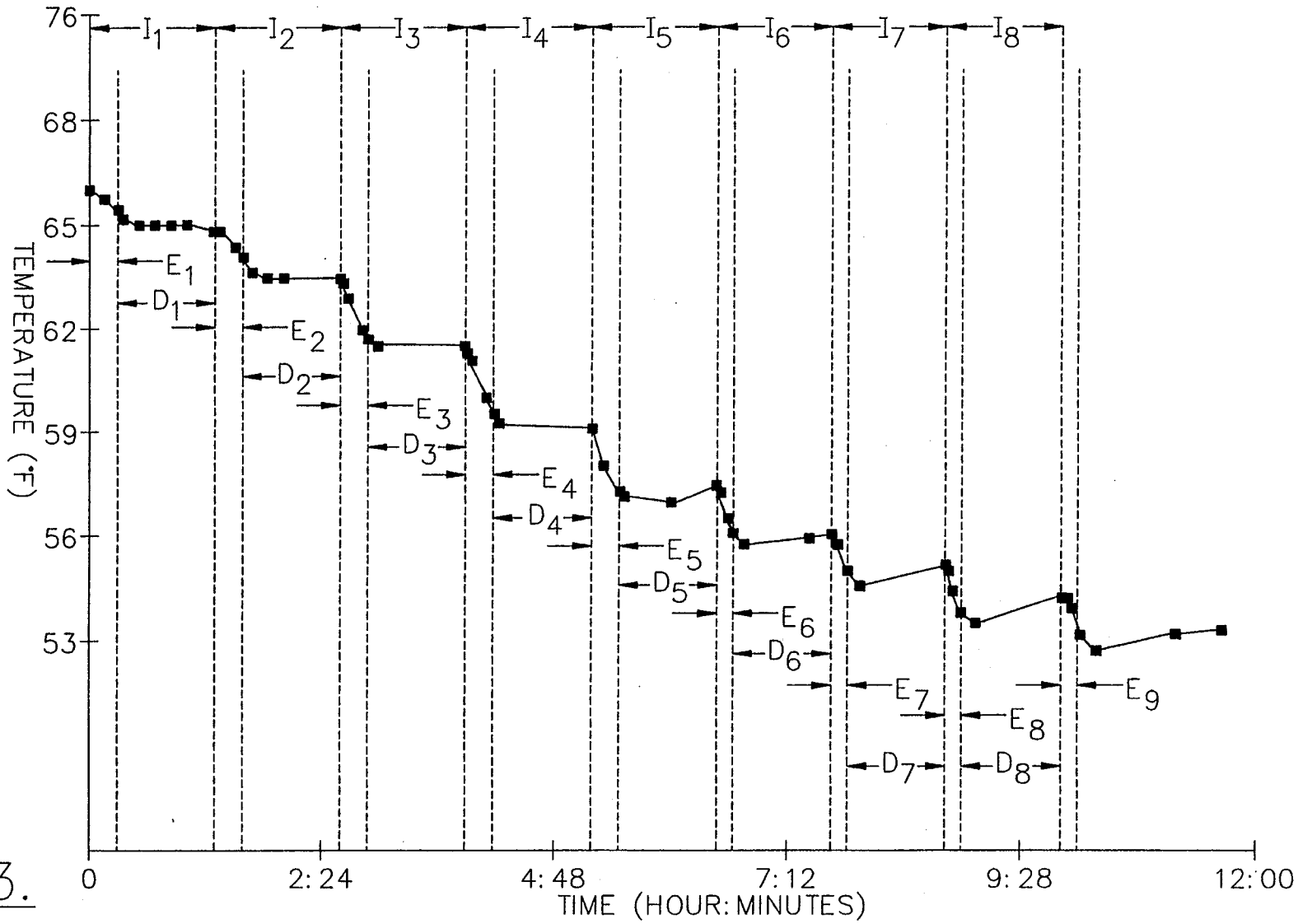
FIG. 3 is a graphical illustration of experimental data showing chilled compartment temperature versus time, according to one embodiment of the present invention.

Referring now to FIG. 3, a graphical illustration of the sensed temperature of a chilled compartment 16 versus time, according to the present invention, is shown. In particular, means 24 for overriding the thermostat control of the chiller enables and disables the supply of electrical power to the chiller 14 to produce a first cooling interval $I_1$, a second cooling interval $I_2$, commencing at the end of the first cooling interval, and subsequent consecutively spaced cooling intervals ($I_3$, $I_4$, $I_5$, . . . ). During the cooling intervals, the temperature of the chilled compartment is lowered to the user selected temperature in stages. Each cooling interval commences with a single enable period ($E_1$, $E_2$, $E_3$, . . . ) during which time the overriding means 24 enables the supply of electrical power to the chiller 14 and the chiller reduces the temperature of the chilled compartment. Each cooling interval also ends with a disable period ($D_1$, $D_2$, $D_3$, . . . ), during which time the overriding means 24 disables the supply of electrical power to the chiller 14. If the bottles of stored wine are relatively warm compared to the sensed temperature at the commencement of the disable period, or if the refrigeration unit has been stored in a relatively warm area, the sensed temperature may actually rise during the disable period. However, if the bottles are relatively cold compared to the sensed temperature, the sensed temperature may actually fall during the disable period. This latter case can happen, for example, in situations where the wine bottles have been stored for a relatively long period of time and the door the refrigeration unit is opened briefly to a warm ambient. In this case, the sensed temperature of the compartment may not accurately reflect the actual temperature of the wine in the stored bottles.

In accordance with the preferred embodiment, the length of an enable period, for a particular cooling interval, is inversely dependent on the difference between the temperature sensed at the commencement of a respective preceding cooling interval and the temperature sensed at the end of the respective preceding cooling interval. Accordingly, the duration of each cooling interval is dependent not only on the temperature of the chilled compartment 16 at the commencement of the respective cooling interval, but is also dependent on the temperatures sensed during the respective preceding cooling interval. For example, if there is a significant decrease in the sensed temperature occurring during a cooling interval (e.g., indicating that the stored wine bottles or the outside ambient are already relatively cool), the length of the enable period corresponding to the next subsequent cooling interval will be relatively short. Alternatively, if there is a relatively small decrease in the sensed temperature (e.g., indicating that relatively warm bottles have been added) then the length of the enable period corresponding to the next subsequent cooling interval will be relatively long.

Accordingly, the temperature controller of the present invention provides means for overriding a thermostat's control of a chiller in a conventional household refrigerator. Thus, the temperature controller dictates when the chiller will cool the chilled compartment and when it will remain inactive. Moreover, by properly configuring the microcontroller, the temperature of the chilled compartment can be controlled in a manner most advantageous to the storage of wine for extended periods of time.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A temperature controller for converting a refrigeration unit of the type including an electrically powered chiller, a chilled compartment and a thermostat for controlling operation of said chiller, to a unit for storing perishables for extended periods of time, comprising:

a housing;

means, adapted to be positioned in said chilled compartment, for sensing a temperature of said chilled compartment; and means in said housing, operatively connected to said temperature sensing means, for overriding the thermostat control of said chiller by enabling the supply of electrical power from an electrical power supply to said chiller, when the sensed temperature of said chilled compartment is above a preselected temperature, and disabling the supply of electrical power from the electrical power supply to said chiller when the sensed temperature is below said preselected temperature.

2. The temperature controller of claim 1, wherein said overriding means enables and disables the supply of electrical power to said chiller to produce a first cooling interval, a second cooling interval, commencing at the end of said first cooling interval, and subsequent consecutively spaced cooling intervals, each commencing at the end of a respective preceding cooling interval, and wherein the length of each cooling interval is dependent on the temperatures sensed during said respective preceding cooling interval.

3. The temperature controller of claim 2, wherein each cooling interval commences with an enable period, during which said overriding means enables the supply of electrical power to said chiller, and ends with a disable period, during which said overriding means disables the supply of electrical power to said chiller.

4. The temperature controller of claim 3, wherein each of said disable periods commences at the end of a respective enable period.

5. The temperature controller of claim 3, wherein the length of each enable period is dependent on the temperature sensed at the commencement of a respective preceding cooling interval and the temperature sensed at the end of said respective preceding cooling interval.

6. The temperature controller of claim 5, wherein the length of each enable period is inversely proportional to a difference between the temperature sensed at the commencement of a respective preceding cooling interval and the temperature sensed at the end of said respective preceding cooling interval.

7. A temperature controller for converting a refrigeration unit of the type including an electrically powered chiller, a chilled compartment and a thermostat for controlling operation of said chiller, to a unit for storing perishables for extended periods of time, comprising:

a housing;

temperature sensing means adapted to be positioned in said chilled compartment;

means in said housing, operatively connected to said temperature sensing means, for overriding the thermostat control of said chiller by enabling the supply of electrical power from an electrical power supply to said chiller, when the sensed temperature of said chilled compartment is above a first preselected temperature, and disabling the supply of electrical power from the electrical power supply to said chiller when the sensed temperature is below said first preselected temperature; and means, mounted on said housing, for visually displaying the sensed temperature of said chilled compartment relative to a second preselected temperature.

8. The temperature controller of claim 7, wherein said displaying means comprises a light emitting diode and wherein said overriding means further comprises means, associated with said temperature sensing means, for adjustably illuminating said light emitting diode to an increased brilliance as the sensed temperature of said chilled compartment approaches said second preselected temperature.

9. The temperature controller of claim 7, further comprising means, associated with said overriding means, for visually displaying an alarm condition if a difference between the sensed temperature of said chilled compartment and said second preselected temperature exceeds a preselected temperature range for a preselected period of time.

10. The temperature controller of claim 7, further comprising means responsive to user actuation for selecting said second preselected temperature.

11. The temperature controller of claim 7, wherein said temperature sensing means comprises a thermistor coupled to said housing.

12. The temperature controller of claim 7, wherein said overriding means comprises a microcontroller, and wherein said housing comprises means for voltage regulating the electrical power supply and for generating a power supply voltage for operation of said microcontroller.

13. The temperature controller of claim 12, wherein said overriding means further comprises means for electrically connecting said chiller to the electrical power supply when said microcontroller generates a predetermined output signal.

14. A refrigeration unit comprising, a chilled compartment;

an electrically powered chiller for chilling said chilled compartment;

a thermostat for controlling operation of said chiller;

means, adapted to be positioned in said chilled compartment, for sensing a temperature of said chilled compartment; and means, operatively connected to said temperature sensing means, for overriding the thermostat control of said chiller by enabling the supply of electrical power from an electrical power supply to said chiller, when the sensed temperature of said chilled compartment is above a first preselected temperature, and disabling the supply of electrical power from the electrical power supply to said chiller when the sensed temperature is below said first preselected temperature.

15. The temperature controller of claim 14, wherein said overriding means enables and disables the supply of electrical power to said chiller to produce a first cooling interval, a second cooling interval, commencing at the end of said first cooling interval, and subsequent consecutively spaced cooling intervals, each commencing at the end of a respective preceding cooling interval, and wherein the length of each cooling interval is dependent on the temperatures sensed during said respective preceding cooling interval.

16. The temperature controller of claim 15, wherein each cooling interval commences with an enable period, during which said overriding means enables the supply of electrical power to said chiller, and ends with a disable period, during which said overriding means disables the supply of electrical power to said chiller.

17. The temperature controller of claim 16, wherein each of said disable periods commences at the end of a respective enable period.

18. The temperature controller of claim 16, wherein the length of each enable period is dependent on the temperature sensed at the commencement of a respective preceding cooling interval and the temperature sensed at the end of said respective preceding cooling interval.

19. The temperature controller of claim 18, wherein the length of each enable period is inversely proportional to a difference between the temperature sensed at the commencement of a respective preceding cooling interval and the temperature sensed at the end of said respective preceding cooling interval.

20. The temperature controller of claim 15, further comprising means for visually displaying the sensed temperature of said chilled compartment relative to a second preselected temperature.

21. The temperature controller of claim 20, wherein said displaying means comprises a light emitting diode and wherein said overriding means further comprises means, associated with said temperature sensing means, for adjustably illuminating said light emitting diode to an increased brilliance as the sensed temperature of said chilled compartment approaches said second preselected temperature.

22. The temperature controller of claim 21, further comprising means, associated with said overriding means, for visually displaying an alarm condition if a difference between the sensed temperature of said chilled compartment and said second preselected temperature exceeds a preselected temperature range for a preselected period of time.

23. The temperature controller of claim 22, further comprising means responsive to user actuation for selecting said second preselected temperature.

24. The temperature controller of claim 23, wherein said second temperature sensing means comprises a thermistor coupled to said housing.

25. The temperature controller of claim 20, wherein said overriding means comprises a microcontroller, and wherein said housing comprises means for voltage regulating the electrical power supply and for generating a power supply voltage for operation of said microcontroller.

26. The temperature controller of claim 25, wherein said overriding means further comprises means for electrically connecting said chiller to the electrical power supply when said microcontroller generates a predetermined output signal.

27. A method of regulating temperature in a refrigeration unit of the type including an electrically powered chiller, a chilled compartment and a thermostat for controlling operation of said chiller, said thermostat being adjustable from a low temperature setting to a high temperature setting, the regulating method comprising the steps of:

sensing a temperature of said chilled compartment;

enabling, independent of said thermostat, the supply of electrical power from an electrical power supply to said chiller, when the temperature of said chilled compartment is above a preselected temperature; and disabling the supply of electrical power from the electrical power supply to said chiller when the sensed temperature is below said preselected temperature.

28. The method of claim 27, wherein said sensing step is preceded by the step of adjusting said thermostat to a low temperature setting, below said preselected temperature.

* * * * *